United States Patent [19]

Sohaei

[11] 4,389,195

[45] Jun. 21, 1983

[54] STEERABLE SURFBOARD

[76] Inventor: Iraj Sohaei, P.O. Box 1475, El Toro, Calif. 92630

[21] Appl. No.: 234,946

[22] Filed: Feb. 17, 1981

[51] Int. Cl.[3] ..... B63H 1/36

[52] U.S. Cl. ..... 440/15; 440/32

[58] Field of Search ..... 440/13–15, 440/21, 32; 441/65, 68, 73, 74

[56] References Cited

FOREIGN PATENT DOCUMENTS

| | | | |
|---|---|---|---|
| 1920564 | 11/1970 | Fed. Rep. of Germany | 440/15 |
| 1169929 | 1/1959 | France | 440/21 |
| 506816 | 12/1954 | Italy | 440/32 |

*Primary Examiner*—Sherman D. Basinger

*Attorney, Agent, or Firm*—Matthew L. Ajeman

[57] ABSTRACT

A steerable, self-propellable surfboard has a steering arrangement attached to a weight-bearing buoyant member such as normally forms a surfboard and arranged for being actuatable by a surfer lying prone on the buoyant member and permitting the surfboard to be maneuvered under control through a liquid in which the surfboard is disposed. The steering arrangement includes a rudder assembly arranged for changing a direction of travel of the surfboard, and a fin assembly which permits the surfer to propel the surfboard through a calm liquid body by causing the member to fishtail or undulate through the liquid in which the surfboard is travelling.

1 Claim, 4 Drawing Figures

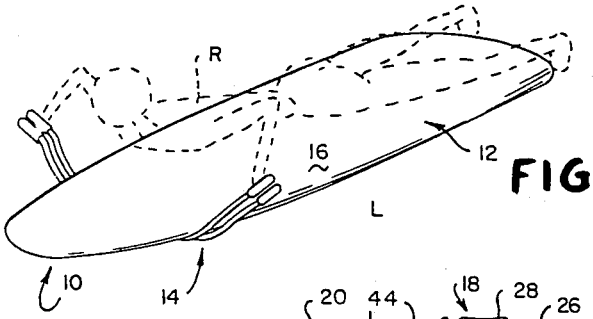
FIG. 1
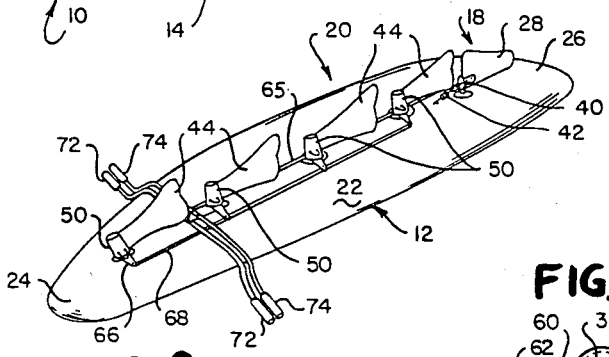
FIG. 2
FIG. 3
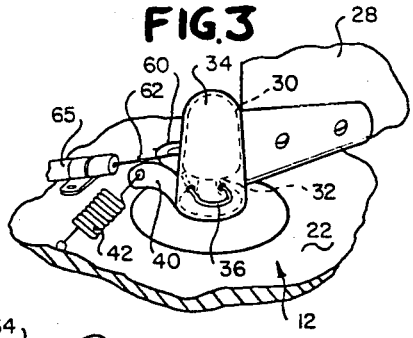
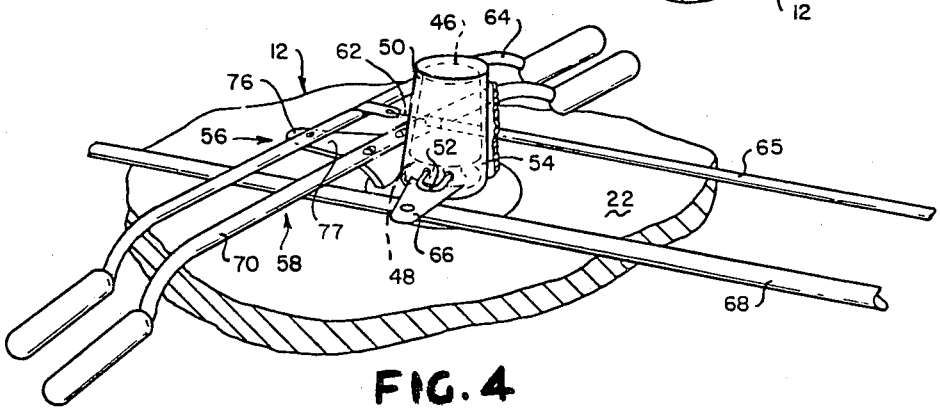
FIG. 4

STEERABLE SURFBOARD

BACKGROUND OF THE INVENTION

1. Field of the Invention

This invention relates generally to water riding craft, and particularly to a watercraft which is steered and propelled by one riding the watercraft.

2. Description of the Prior Art

It is well known to use a substantially planar body to ride waves. Because the waves usually are found in surf adjacent a shoreline, such sport is generally referred to as "surfing" and the bodies used as "surfboards". Normally, a "surfer", as the board riders are called, stands upright on the board and steers same by the positioning of feet and placement of weight relative to the board as it is being propelled by a wave. It has been proposed, however, to enhance steering of surfboards by provision thereon of a rudder. For example, U.S. Pat. No. 3,747,138, issued July 24th, 1973 to D. R. Morgan, discloses a hydrofoil surfboard construction in which the nose, or forward, hydrofoil may be a steerable foil. This known arrangement contemplates positioning the steerable foil by a pedal actuated by the feet of a surfer standing upright in the conventional manner on a wave propelled board.

It is advantageous, however, to permit the surfer to assume a sitting or prone position on the board in order to improve the stability of the watercraft. Further, it has been proposed to provide such boards with propulsion systems which permit the board to be used in calm, safer, water. Accordingly, U.S. Pat. No. 3,199,485, issued Aug. 10th, 1965 to D. S. Snider, discloses a sailing surfboard incorporating a rudder and tiller to permit steering of the board by one in a sitting position thereon, while U.S. Pat. No. D196,947, issued Nov. 19th, 1963 to F. I. Churchman, shows a board termed a water sled and provided with a nose rudder positionable by one laying prone on the board.

A major disadvantage of the latter two mentioned devices, however, is that they do not readily permit execution of "fish-tailing" movements by a rider of the device. Although the steering foils will assist in orienting the board relative to a wave propelling the board, or to a propelling wind, they do not readily permit the successive side-to-side turning movements frequently performed by an upright surfer and which cause the board to fishtail as it moves along. More importantly, neither of these arrangements permits the rider to control the propulsion of the board in a totally satisfactory manner.

U.S. Pat. No. 1,767,811, issued June 24, 1930 to P. M. Pollard, discloses a surfboard having a downwardly disposable flap intended to present an increased surface area to a wave propelling the board, while U.S. Pat. Nos. 3,194,286, issued July 13th, 1965 to R. B. Anderson, and 3,256,850, issued June 21st, 1966 to C. H. Bramson, discloses surfboards provided with flippers which can be used by a rider to propel the board.

It also has been proposed to provide ships with fore-and-aft disposed plural rudder arrangements to improve the steerability of large, slow moving, cumbersome vessels, especially in harbors and other crowded areas. Examples of such arrangements can be found in U.S. Pat. Nos.: 367,771, issued Aug. 3rd, 1887 to J. C. Witmer; 2,251,133, issued July 29th, 1941 to H. H. Horstman; 2,972,324, issued Feb. 21st, 1961 to C. Williams; and 3,080,845, issued Mar. 12th, 1963 to E. G. Pollak.

SUMMARY OF THE INVENTION

It is an object of the present invention to provide a steerable surfboard whose attitude relative to liquid surface on which it is riding can be varied as well as the direction of travel thereof.

It is another object of the present invention to provide a steerable surfboard having a rudder disposed at the rear end of the board and controllable by a surfer lying prone on the board.

Still another object of the present invention is to provide a steering arrangement including a rudder assembly and a fin assembly mountable on a surfboard for permitting a rider on the board to propel as well as steer the board.

These and other objects are achieved according to the present invention by providing a steerable surfboard having: a buoyant member arranged for bearing weight on a liquid; and a steering arrangement mounted on the buoyant member and actuable by a rider on the buoyant member for permitting the buoyant member to be maneuvered through a liquid in which the buoyant member is moveably disposed.

Preferably, the buoyant member is a substantially planar member configured for riding along on the liquid in which the member is disposed, and having a direction of travel relative to the liquid surface.

The steering arrangement preferably includes a rudder assembly mounted on the buoyant member and actuable by a rider on the member for causing the buoyant member to change a direction of travel relative to an instanteous direction of travel. The steering arrangement is used in conjunction with a propelling arrangement including a fin assembly mounted on the buoyant member and actuatable by a rider on the member for causing the member to fishtail through a liquid in which the member is disposed.

The buoyant member advantageously has a forward end and a rear end spaced from one another and defining a normal direction of travel of the member. The rudder assembly is arranged on the member adjacent the rear end of the member, with the fin assembly being arranged on the member between the rudder assembly and the forward end of the member.

The rudder assembly preferably comprises a rudder in the form of a substantially planar piece mounted on the buoyant member for pivoting movement about an axis substantially perpendicular to the plane of the member. A control arrangement is mounted on the member and attached to the rudder for permitting positioning of the rudder from a point spaced from the rear end of the member.

The fin arrangement preferably includes at least one blade mounted on the buoyant member for pivoting movement relative to the member. An actuating arrangement mounted on the member is attached to the blade for permitting pivoting of the blade from a point on the member spaced from the rear end of the member.

The control and actuating arrangements advantageously include pivotally mounted levers disposed adjacent one another near the forward end of the board for selective and simultaneous manipulation by a rider lying prone on the member.

Alternatively to constructing a board and steering arrangement as a unit, the steering and propelling arrangements can be provided as a kit for mounting on any suitable surfboard available on the market.

BRIEF DESCRIPTION OF THE DRAWINGS

FIG. 1 is a diagrammatic, top perspective view showing a steerable, rider-propelled surfboard according to the present invention and the manner in which same is used.

FIG. 2 is a diagrammatic, bottom perspective view showing the surfboard of FIG. 1.

FIG. 3 is a fragmentary, detail, perspective view showing, to a larger scale, the right hand portion of FIG. 2.

FIG. 4 is a fragmentary, detail, perspective view showing, to a larger scale, the left hand portion of FIG. 2.

DESCRIPTION OF THE PREFERRED EMBODIMENTS

Referring now more particularly to FIG. 1 of the drawing, a steerable, rider-propellable surfboard 10 according to the present invention is formed by a weight-bearing buoyant member 12 shown riding on a liquid 1, such as a pool, river, lake, sea, ocean, or other large body of calm water, and being controlled by a rider, or surfer, R lying prone on member 12. A calm liquid surface is preferred for using board 10, with an undulating surf as needed for conventional surfboards actually being considered undesirable for using board 10. A steering arrangement 14 is mounted on buoyant member 12 for being actuated by rider R, lying on an upper face 16 of member 12, and permitting member 12 to be manuevered through liquid L in which member 12 is disposed.

The buoyant member 12 is a substantially planar member configured for riding, or floating, on the surface of a liquid L in which member 12 is disposed; member 12 having a direction of travel over the liquid surface at any instant in time. Face 16 is a substantially planar face of member 12, and normally is disposed facing upwardly as seen in FIG. 1.

Referring to FIGS. 2 through 4 in addition to FIG. 1, steering arrangement 14 includes a rudder assembly 18 mounted on the buoyant member 12 and actuatable by rider R on member 12 for causing member 12 to change a direction of travel on the surface of liquid L.

Surfboard 10 also includes a propelling arrangement 19 comprising a fin assembly 20 mounted on buoyant member 12 so as to extend therefrom codirectionally with rudder assembly 18 and arranged for being actuatable by rider R on member 12 and causing member 12 to fishtail through liquid L in which member 12 is disposed. As face 16 of member 12 forms a surface receiving rider R, normally downwardly-directed face 22 of member 12 forms a surface receiving the rudder assembly 18 and fin assembly 20.

The buoyant member 12 has a forward end 24 and a rear end 26 spaced from one another and defining a normal direction of travel of member 12. The rudder assembly 18 is arranged on member 12 adjacent the rear end 26 of member 12, with fin assembly 20 being arranged on the member 12 between rudder assembly 18 and the forward end 24 of member 12.

The rudder assembly 18 includes a rudder 28 in the form of a substantially planar piece mounted on the buoyant member 12 as by a pin 30 for pivoting movement about an axis substantially perpendicular to the plane of the member 12. Pin 30 is provided with a flanged portion permitting attachment of pin 30 to face 22 of member 12 as by conventional screw fasteners. Also provided on pin 30 is an annular groove 32 preferably disposed near the flanged portion of pin 30, while a sleeve 34 affixed to rudder 28 is moveably disposed on pin 30 for supporting rudder 28 on same, and is retained on pin 30 as by the illustrated clip 36 constructed from a suitable spring steel or other resilient material removeably arranged in a pair of suitably spaced apertures 38 and embracing pin 30 in groove 32. A lug 40 is provided on sleeve 34 for attachment thereto one end of a coiled tension spring 42, and the like, the other end of which is connected in a conventional manner, such as by an eye screw, to face 22 of member 12. In this manner, with spring 42 extending along the longitudinal extent of member 12 from sleeve 34, rudder 28 will be biased toward a "neutral" or fore-and-aft position relative to member 12. The fin assembly 20 comprises at least one blade 44 mounted on buoyant member 12 by a post 46 extending perpendicularly from member 12 for pivoting movement relative to member 12. Like pin 30, a flanged portion of post 46 facilitates attachment to face 22 of member 12, and an annular groove 48 is provided in post 46 for retaining thereon a sleeve 50 to which blade 44 is attached as by a clip 52 disposed in apertures 54 and groove 48. A plurality of blades 44, all mounted as described above, preferably are provided on member 12, with four blades 44 being illustrated. All blades 44 provided are operatively connected together in a manner to be described below.

The rudder assembly 18 further includes a control arrangement 56 mounted on the member 12 and attached to the rudder 28 for permitting positioning of rudder 28 from a point spaced from the rear end 26 of member 12. Similarly, fin assembly 20 further includes an actuating arrangement 58 mounted on the member 12 and attached to blades 44 for permitting pivoting of blades 44 from a point on the member 12 spaced from the rear end 26 of member 12.

The control arrangement 56 includes a crank 60 affixed to rudder 28. A connector element 62 is pivotally attached to the crank 60 and arranged for manipulating rudder 28. A lever 64 is pivotally mounted on buoyant member 12 and connected pivotally to connector element 62, at a point offset from the pivotal mounting of lever 64, for permitting a rider R of member 12 to steer member 12 by selectively turning rudder 28 through pivoting of lever 64 and reciprocating of element 62 to swing crank 60.

As illustrated, element 62 is a flexible wire slidably disposed in a sleeve 65 affixed to member 12 in a suitable, known manner at a point adjacent to, but spaced from, crank 60 at a one end of sleeve 65, and affixed to actuating arrangement 58 at the other end in a manner to be described below. By proper arrangement of element 62 and sleeve 65, control of rudder 28 can be realized independently of the arrangement 58 because sleeve 65, being flexible like element 62, will bend and adjust for movement of arrangement 58 in a manner commonly employed with handlebar mounted devices on bicycles, motorcycles, and the like. Further, by constructing element 62 from a flexible yet stiff material, such as a steel wire, rudder 28 can be caused to move in either direction from the neutral position thereof.

The actuating arrangement 58 includes further cranks 66 affixed to respective ones of blades 44. A further connector element 68 is pivotally attached to cranks 66 for swinging same by reciprocating motion, with element 68 being a rigid length of rod, and the like, preferably constructed from aluminum to reduce weight. A further lever 70 is pivotally mounted on the member 12, with further connector element 68 being pivotally attached to lever 70 at a point offset from the pivotal mounting of the lever 70. The latter is arranged for manipulating blades 44 in unison and permitting rider R on member 12 to vary the attitude of member 12 and cause same to move through liquid L by a force similar to that used in skulling a skiff, and the like.

As can be seen in FIG. 2, rudder 28 and blades 44 have substantially parallel pivot axis which are substantially perpendicular to the plane of the buoyant member 12. As seen in FIGS. 1,2, and 4, levers 64 and 70 extend substantially transverse of a forward end 24 to rear end 26 extent of member 12 and terminate outboard of member 12 in respective handles 72 and 74 arranged for being gripped by a rider R disposed on face 16 of member 12. As best seen in FIG. 4, levers 64 and 70 are pivotally mounted along the central fore-and-aft extent line on which rudder 28 and blades 44 are disposed. Lever 64 is, in the illustrated embodiment, pivotally mounted at point 76 on a bracket 77 extending from the pivot point of lever 70. Similarly, sleeve 65 is anchored on lever 70 near the pivot point to permit element 62 to remain unaffected by movements of lever 70.

It is to be understood that all of the aforementioned pivots can be formed by pins in a conventional manner.

Further, the blades such as blades 44 can be arranged to pivot about an axis 90 degrees to that shown in the drawing in order to create an undulating motion relative to the plane of the surface of liquid L.

As can be readily understood from the above description and from the drawing, a steerable surfboard arrangement according to the present invention permits a surfer lying prone on the board to control direction of travel of the board while propelling the board with "fishtail" movements.

It is to be understood that the above description of the present invention is capable of various changes, modifications, and adaptions, and such are intended to be included within the meaning and range of equivalents of the following claims.

I claim:

1. A steerable, self-propellable surfboard, comprising, in combination:

(A) a buoyant member forming a means for bearing weight on a liquid, the buoyant member being a substantially planar member configured for riding on a liquid in which the member is disposed, the member having a direction of travel relative to the liquid surface; and (B) steering means mounted on the buoyant member and actuatable by a rider of the buoyant member for permitting the buoyant member to be maneuvered through a liquid in which the buoyant member is disposed, the steering means including, in combination:

I. rudder means mounted on the buoyant member and actuatable by hands of a rider on the member for causing the buoyant member to change a direction of travel of the member relative to the liquid surface; and II. fin means mounted on the buoyant member and actuatable by hands of a rider on the member for causing the member to fishtail through a liquid in which the member is disposed for propelling the member through the liquid, the buoyant member having a forward end and a rear end spaced from one another and defining a normal direction of travel of the member, the rudder means being arranged on the member adjacent the rear end of the member, and the fin means being arranged on the member between the rudder means and the forward end of the member, the rudder means comprising, in combination:

(a) a rudder in the form of a substantially planar piece mounted on the buoyant member for pivoting movement about an axis substantially perpendicular to the plane of the member; and (b) control means mounted on the member and attached to the rudder for permitting positioning of the rudder from a point spaced from the rear end of the member, the fin means comprising, in combination:

(c) at least one blade mounted on the buoyant member for pivoting movement relative to the member; and (d) actuating means mounted on the member and attached to the blade for permitting pivoting of the blade from a point on the member spaced from the rear end of the member, the control means including a crank provided on the rudder, a connector element pivotally attached to the crank and arranged for manipulating the rudder, and a lever pivotally mounted on the buoyant member and connected to the connector element for permitting a rider of the member to steer the member by selectively turning the rudder, the actuating means including a further crank provided on the blade at the fin means, a further connector element pivotally attached to the further crank, and a further lever pivotally mounted on the member, the further connector element being pivotally attached to the further lever, the further lever being arranged for manipulating the blade and permitting a rider on the member to propel the member through the liquid in which the member is disposed, there being a plurality of blades forming the fin means, with the rudder and blades having substantially parallel pivot axis which are substantially perpendicular to the plane of the buoyant member, the member having a pair of substantially parallel, planar, oppositely directed faces, one of the faces forming a surface receiving a rider of the member, the other of the faces forming a surface receiving the rudder, blades, and levers, the latter extending longitudinally substantially transverse of a forward to rear end extent of the member and terminating outboard of the member in handles arranged for being gripped by a rider on the member, a bracket extending from a pivot point of the further lever, the lever being pivotally mounted on the bracket extending from a pivot point of the further lever and the connector element being a wire and sleeve arrangement, with the wire being connected to the crank and to the lever and the sleeve being affixed to the member and the further lever.

* * * * *